US005858557A

United States Patent [19]

Yoon et al.

[11] Patent Number: 5,858,557

[45] Date of Patent: Jan. 12, 1999

[54] NICKEL/GOLD PLATING OF A COPPER-REFRACTORY METAL MATERIAL

[76] Inventors: Sunghee Yoon, 3218 Centralia St., Lakewood, Calif. 90712; William A. Reed, 1209 Goodman Ave., Redondo Beach, Calif. 90278

[21] Appl. No.: 949,981

[22] Filed: Oct. 14, 1997

[51] Int. Cl.[6] ..... B32B 15/20; B05D 1/36; C25D 5/12; C23C 28/02

[52] U.S. Cl. ..... 428/672; 428/675; 427/405; 427/438; 427/433.1; 427/319; 427/320; 427/305; 205/181; 205/184; 205/187; 205/191; 205/210; 205/212; 205/215; 205/917; 205/50

[58] Field of Search ..... 427/405, 438, 427/433.1, 319, 320, 305; 205/181, 184, 187, 191, 210, 212, 215, 917, 50; 428/671, 672, 675

[56] References Cited

U.S. PATENT DOCUMENTS 4,960,493 10/1990 Troup ..... 204/32.1

*Primary Examiner*—Kathryn Gorgos
*Assistant Examiner*—Edna Wong
*Attorney, Agent, or Firm*—Terje Gudmestad; Georgann S. Grunebach; Michael W. Sales

[57] ABSTRACT

A copper-tungsten or copper-molybdenum substrate is plated with a nickel/gold plating by first activating a surface of the substrate. In activating, the surface is contacted to a concentrated alkaline solution at elevated temperature, and then to a concentrated acidic solution. The surface is thereafter plated with a nickel strike layer, plated with a nickel primary layer overlying the nickel strike layer, sintered, re-activated in a concentrated acidic solution, plated with a nickel secondary layer overlying the nickel primary layer, and plated with a gold layer overlying the nickel secondary layer.

19 Claims, 2 Drawing Sheets

NICKEL/GOLD PLATING OF A COPPER-REFRACTORY METAL MATERIAL

This invention was made with Government support under Contract No. F04701-92-C-0049 awarded by the United States Air Force. The Government has certain rights in this invention.

BACKGROUND OF THE INVENTION

This invention relates to plating of copper-refractory metal substrates, such as copper-tungsten substrates with a nickel/gold plating.

Material made of copper and a refractory metal such as tungsten or molybdenum is used as the carrier substrate for gallium arsenide microelectronic chips. The copper-refractory metal material has a relatively high thermal conductivity, which permits the rapid removal of heat from the chips. It also has a coefficient of thermal expansion that is closely matched to that of the gallium arsenide chip, so that thermal mismatch strains are small.

The substrate is plated with a nickel/gold coating prior to attachment of the microelectronic chips. The nickel/gold coating includes one or more nickel layers adjacent to the surface of the substrate, and a gold layer overlying the nickel layer(s). The gold coating allows the chip to be soldered to the surface of the substrate, and protects the surface of the substrate against oxidation or corrosion damage. The nickel layer(s) improve the adherence of the gold layer to the substrate and act as a diffusion barrier of copper to the gold layer.

In the conventional plating approach, the substrate is prefired at elevated temperature, typically about 850° C., in hydrogen to remove surface metal oxides. It is next chemically activated by dipping into concentrated hydrochloric acid to remove additional metal oxides. The substrate is thereafter plated with a nickel strike layer and furnace sintered in hydrogen at about 850° C. to improve the adherence of the nickel strike layer to the substrate. The strike-plated-and-sintered substrate is again chemically activated by dipping into concentrated hydrochloric acid. A nickel plating is plated over the activated nickel strike layer, and the gold layer is plated over the nickel layer.

The conventional approach is operable, but has drawbacks. Blisters are sometimes observed to form on the plated surface during processing. These blisters are believed to result from the rapid formation of tenacious oxides on the surface of the substrate that prevent the adherence of the overlying layers. The resulting substrate having a blistered nickel/gold coating is not acceptable for use in the carrier application, inasmuch as the coating may spall away, the gallium arsenide chip may not adhere properly to the substrate, and the blistered surface may cause the chip to be cracked.

There is a need for an improved approach to the coating of copper-refractory metal materials, such as those used in microelectronic applications as chip carriers. The present invention fulfills this need, and further provides related advantages.

SUMMARY OF THE INVENTION

The present invention provides a technique for applying a nickel/gold plated coating onto a substrate of a copper-refractory metal material, with a high yield of acceptably coated articles. The coating is blister-free. The process steps of the invention are no more expensive to practice than the conventional process steps, and their effective processing cost per successfully coated article is less in the present approach due to the higher yield of good parts.

In accordance with the invention, a method of plating a substrate comprises the step of providing a substrate made of a copper-refractory metal material, and thereafter first activating a surface of the substrate. The step of first activating is accomplished by contacting the surface of the substrate to a concentrated alkaline solution at an alkaline activation temperature greater than room temperature, and thereafter contacting the surface of the substrate to a concentrated acidic solution. The surface of the substrate is next first plated with a nickel strike layer, and thereafter second plated with a nickel primary layer overlying the nickel strike layer. The substrate, the nickel strike layer, and the nickel primary layer are thereafter optionally sintered to ensure the consolidation of the layers and their adherence to the surface of the substrate. The process continues with a second activating of the surface of the nickel primary layer by contacting the surface of the nickel primary layer to a concentrated acidic solution. The surface of the substrate is thereafter third plated with a nickel secondary layer overlying the nickel primary layer, and thereafter fourth plated with a gold layer overlying the nickel secondary layer.

In combination with the initial cleaning, the activating procedures of the present invention fully remove existing oxides and other surface structure which would otherwise interfere with the successful deposition of the nickel strike, nickel primary, nickel secondary, and gold layers. The first activation using both concentrated alkaline and concentrated acidic activators removes the oxide from the refractory metal and the copper, respectively, preparing them for the subsequent plating. The result is an article that is coated with a nickel/gold coating and has no blisters or other damage that interfere with the integrity of the coating or soldering to the coating.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
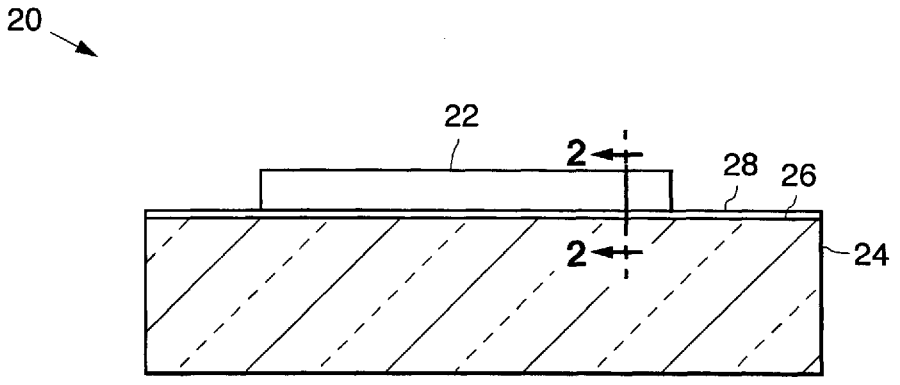
FIG. 1 is an elevational view of a microelectronic assembly including a microelectronic device supported on a nickel/gold-coated copper-refractory metal substrate.

FIG. 1 depicts a microelectronic assembly 20 having a microelectronic device 22 mounted to a carrier substrate 24. The microelectronic device 22 may be any operable such device. The preferred microelectronic device 22 is a gallium arsenide-based integrated circuit chip, but the invention is not limited to any particular such device.

The carrier substrate 24 is a composite material made primarily of copper and a refractory metal, preferably tungsten or molybdenum. A preferred composition for the carrier substrate is about 80–90 percent by weight tungsten, balance copper, but the use of the invention is not limited to this composition. Minor amounts of other elements may also be present. The composition of the substrate is typically selected to achieve good thermal conductivity, and therefore has a moderate amount of copper, but also contains a sufficient amount of the refractory metal to adjust the thermal expansion of the substrate 24 to be approximately that of the microelectronic device 22 so as to minimize thermal expansion mismatch stresses and strains.

The carrier substrate 24 has a surface 26, with a coating 28 overlying and bonded to the surface 26. The coating 28, shown in greater detail in FIG. 2, comprises multiple overlying layers of metal deposited sequentially overlying the surface 26. (The thicknesses of the layers are not drawn to scale.) A nickel strike layer 30 is directly in contact with the surface 26 of the substrate 24. The nickel strike layer 30 is preferably relatively thin, typically from about 15 microinches to about 20 microinches in thickness. (A microinch is $10^{-6}$ inches.) Overlying the nickel strike layer 30 is a nickel primary layer 32, which is preferably from about 0.0001 inch to about 0.0002 inch thick. Overlying the nickel primary layer 32 is a nickel secondary layer 34, which is preferably from about 0.0001 inch to about 0.0002 inch thick. The three nickel layers 30, 32, and 34 are described separately because, as will be discussed subsequently, they are deposited sequentially. However, they are typically not individually distinguishable metallographically at low magnifications. Overlying the nickel secondary layer 34 is a gold layer 36, which is preferably from about 50 to about 100 microinches thick. The layers are described as "nickel" and "gold", where these terms encompass not only the pure metals but also their alloys. There are no absolute limits on the thicknesses of these layers, and the indicated thickness ranges are preferred.

Figure 2:
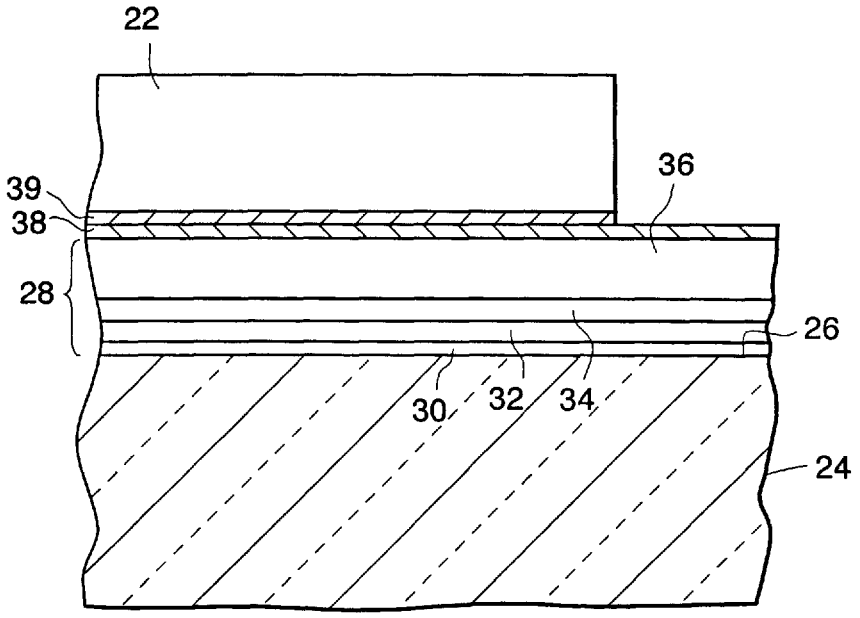
FIG. 2 is an enlarged, detailed sectional view of the substrate of FIG. 1, taken generally on line 2—2.

FIG. 2 also shows the preferred manner in which the microelectronic device 22 is affixed to the substrate 24 structure. A solder layer 38 is applied overlying the gold layer 36. The solder is preferably a gold-tin alloy. The underside of the microelectronic device 22 is coated with a gold layer 39. The gold layer 39 is pressed against the solder layer 38, and the assembly is heated to a temperature at which the solder melts, which is about 280° C. in the case of the gold-tin solder alloy. After the solder has melted and wet the adjacent gold layers 36 and 39, the assembly is cooled to solidify the solder and bond the microelectronic device 22 to the substrate 24.

Figure 3:
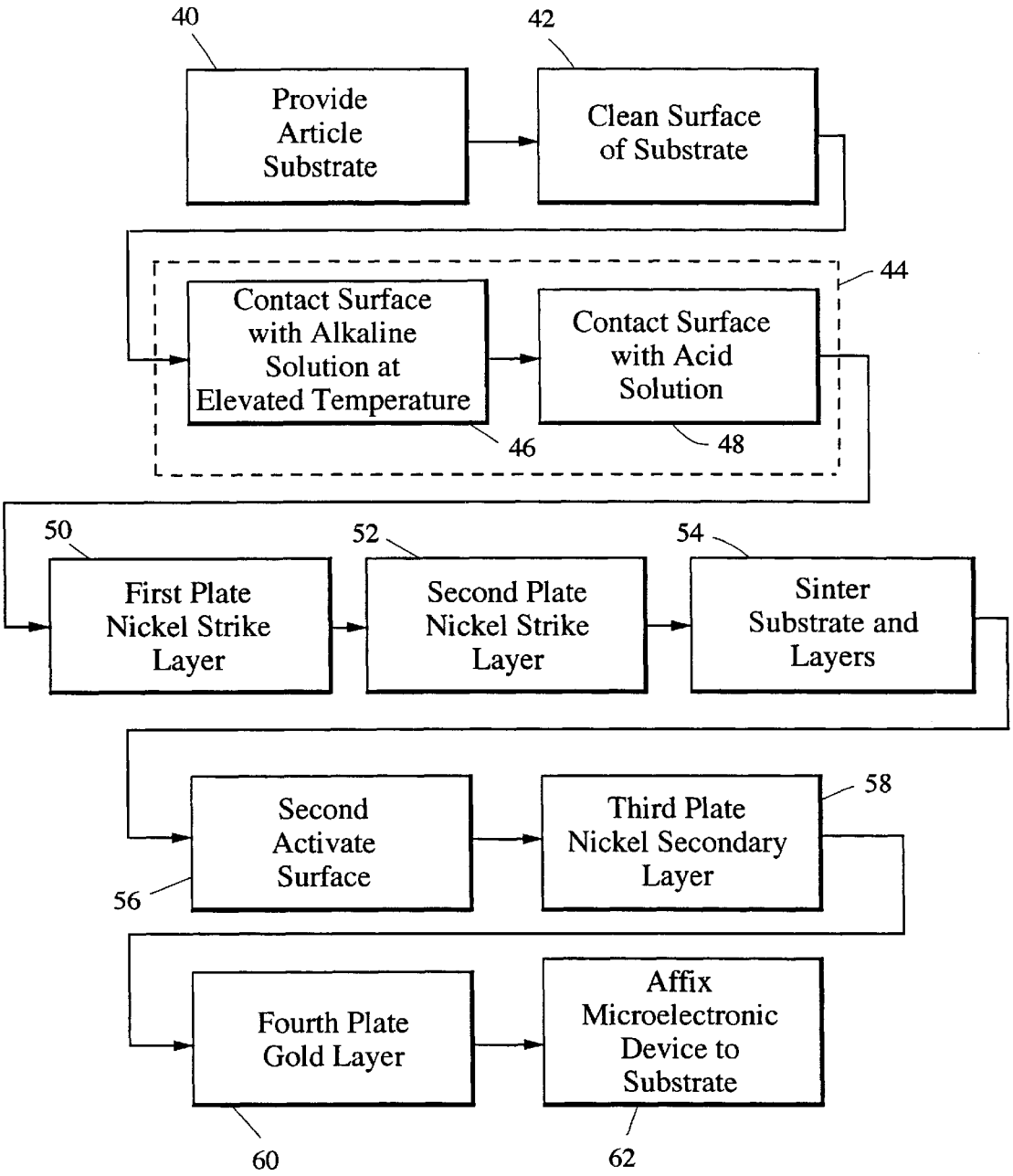
FIG. 3 is a block flow diagram of a preferred approach for practicing the invention.

FIG. 3 depicts a preferred method for practicing the approach of the invention. The carrier substrate 24 is provided, numeral 40. The substrate 24 preferably is 15 weight percent copper—85 weight percent tungsten for use as a carrier for the microelectronic device 22. The composition and dimensions may be varied as needed.

The surface 26 is cleaned, numeral 42, to remove dirt, grease, other organics, scale, a portion of the oxide layer on the surface, and any other agents that may be readily removed. The cleaning is accomplished by first ultrasonically cleaning the surface 26 in an alkaline cleaner such as Brulin 815. The surface is then electrochemically cleaned by making it the cathode in a cleaning solution such as Oakite 90 at a current of 150–200 amperes per square foot for one minute. The surface is thereafter rinsed in hot de-ionized water.

The cleaned surface 26 is first activated, numeral 44, in a two-step activation treatment. In the first step, numeral 46, the cleaned surface is contacted to an aqueous concentrated alkaline solution, preferably having about 300 grams per liter of sodium hydroxide, potassium hydroxide, or a mixture thereof, at a temperature greater than room temperature, and preferably about 170° F. In the second step, numeral 48, the surface is thereafter contacted to a concentrated aqueous solution, preferably hydrochloric acid, typically about 50 percent by volume HCl. Other concentrated acid solutions such as concentrated sulfuric acid may also be used.

The two-step activation treatment is employed to remove the metal oxide from the copper-tungsten surface. The concentrated alkaline solution removes oxides from the tungsten exposed at the surface 26. The concentrated hydrochloric acid solution removes oxides from the copper exposed at the surface 26. By contrast, in the prior approach there is no activation in concentrated alkaline solution, and the pre-firing treatment is used, which together result in an imperfectly prepared surface having residual oxides thereon. These oxides, if present, produce imperfect bonding and blistering in the final product. The present processing removes the oxides to avoid these problems.

After activation of the surface 26, the layers 30 and 32 are applied to the surface, preferably by plating. Immediately after the completion of the second activation step 48, the substrate is first plated, numeral 50, with the nickel strike layer 30. The first plating 50 is accomplished by any operable process, but preferably the first plating 50 is accomplished by electroplating nickel from a nickel chloride solution (termed a Wood's or Watt's nickel bath) with a current of about 50–75 amperes per square foot and a voltage of about 2 volts. The nickel strike layer 30 is preferably relatively pure nickel, and is from about 15 microinches to about 20 microinches thick. The nickel strike layer 30 aids in achieving good adhesion of the overlying layers 32, 34, and 36 to the substrate 24.

The substrate 24 is thereafter immediately second plated, numeral 52, with the nickel primary layer 32 overlying the nickel strike layer 30. The second plating 52 is accomplished by any operable process, but preferably the second plating 52 is accomplished by electrolytic plating from a nickel sulfamate solution at about 0.2 ampere per square inch. The nickel primary layer 32 is preferably relatively pure nickel, and is from about 0.0001 inch to about 0.0002 inch thick.

The substrate 24, together with the overlying nickel strike layer 30 and nickel primary layer 32, is optionally but preferably sintered, numeral 54, to consolidate the layers 30 and 32 and improve their bonding to the substrate 24. Sintering is preferably accomplished by heating to about 830° C. for 10 minutes, in a hydrogen atmosphere.

During the sintering 54, the nickel primary layer 32 oxidizes to some degree. The sintered structure is therefore subsequently second activated, numeral 56. However, the second activation is less complex to perform than the first activation, because only the nickel primary layer is present at the upper exposed surface and is oxidized. The second activation therefore is accomplished in a single step, preferably by contacting the nickel primary layer 32 to a concentrated solution of hydrochloric acid, typically about 50 percent by volume HCl. Other concentrated acid solutions such as concentrated sulfuric acid solution may be used.

The substrate 24 is thereafter immediately third plated, numeral 58, with the nickel secondary layer 34 overlying the activated nickel primary layer 32. The third plating 58 is accomplished by any operable process, but preferably the third plating 58 is accomplished by electrolytic plating from a nickel sulfamate solution at about 0.2 ampere per square inch. The nickel secondary layer 34 is preferably relatively pure nickel, and is from about 0.0001 inch to about 0.0002 inch thick.

The substrate 24 is thereafter immediately fourth plated, numeral 60, with the gold layer 36 overlying the nickel secondary layer 34. The fourth plating 60 is accomplished by any operable process, but preferably the fourth plating 60 is accomplished by electrolytic plating from a potassium gold cyanide solution of a concentration of about 1 ounce per gallon with a current of about 3 amperes per square foot. The gold layer 36 is preferably relatively pure gold, and is from about 50 microinches to about 100 microinches thick.

The substrate 24, with the four overlying plated layers 30, 32, 34, and 36, is thereafter inspected as necessary for plating thickness, visual appearance, plating adhesion, and any other properties of interest.

If the plated substrate 24 passes the inspection, the microelectronic device 22 is affixed to the plated surface, numeral 62, preferably by soldering in the manner discussed previously, to complete the preparation of the assembly 20. There may be additional steps such as forming external interconnections, which are not part of the present invention.

The present approach may be contrasted with the prior approach for preparation of copper-refractory metal substrates for microelectronic devices. In that prior approach, there was no alkaline activation in combination with the acid activation in the first activation, and a pre-firing step was employed. The result was residual oxide on the surface of the substrate, which led to blistering and incomplete bonding of the device to the substrate. The present approach, which uses the combined alkaline/acidic first activation and requires no prefiring, avoids these problems.

The present approach has a cost approximately the same as the prior approach, but the present approach has a substantially greater yield of blister-free substrates. The effective cost-per-usable substrate for the present process is therefore less than for the prior process. The substrate must be free of blisters to be usable, because the blisters cause the surface to be uneven so that the microelectronic device 22 cannot be properly affixed to it. Even if the device could be affixed, debonding during service due to the blisters would be a major concern. Another advantage of the present invention is a shorter process cycle time. Additionally, it may be possible, through careful control of the plating operations, to reduce or eliminate the sintering step 54 to further reduce the cycle time.

The present invention has been reduced to practice. A total of about 100 plated substrates were prepared by the approach of steps 40–60 of FIG. 3. The yield was 100 percent, meaning that all of the plated substrates met standards established for their use as substrates for microelectronic devices. By comparison, the yield of substrates prepared by the prior process is typically about 50 percent.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of preparing an article, comprising the steps of providing a substrate of a copper-refractory metal material; thereafter first activating a surface of the substrate, the step of first activating including the steps of contacting the surface of the substrate with a concentrated alkaline solution at an alkaline activation temperature greater than room temperature, and thereafter contacting the surface of the substrate with a concentrated acidic solution; thereafter first plating the surface with a nickel strike layer; thereafter second plating the surface with a nickel primary layer overlying the nickel strike layer; thereafter second activating the surface of the nickel primary layer, the step of second activating including the step of contacting the surface of the nickel primary layer with a concentrated acidic solution; thereafter third plating the surface with a nickel secondary layer overlying the nickel primary layer; and thereafter fourth plating the surface with a gold layer overlying the nickel secondary layer.

2. The method of claim 1, wherein the refractory metal is selected from the group consisting of tungsten and molybdenum.

3. The method of claim 1, wherein the step of contacting the surface with a concentrated alkaline solution includes the step of furnishing an aqueous alkaline solution selected from the group consisting of sodium hydroxide solution, potassium hydroxide solution, and mixtures thereof.

4. The method of claim 1, wherein the step of contacting the surface with a concentrated acidic solution includes the step of furnishing a concentrated acid solution selected from the group consisting of hydrochloric acidic solution and sulfuric acid solution.

5. The method of claim 1, wherein the step of contacting the surface of the substrate with a concentrated alkaline solution at an alkaline activation temperature includes the step of heating the concentrated alkaline solution to the alkaline activation temperature of about 170° F.

6. The method of claim 1, wherein the step of first plating includes the step of electrolytically plating the nickel strike layer from a nickel chloride solution.

7. The method of claim 1, wherein the step of first plating includes the step of plating the nickel strike layer to a thickness of from about 15 microinch to about 20 microinch.

8. The method of claim 1, wherein the step of second plating includes the step of electrolytically plating the nickel primary layer from a nickel sulfamate solution.

9. The method of claim 1, wherein the step of second plating includes the step of plating the nickel primary layer to a thickness of from about 0.0001 to about 0.0002 inches.

10. The method of claim 1, wherein the step of third plating includes the step of electrolytically plating the nickel secondary layer from a nickel sulfamate solution.

11. The method of claim 1, wherein the step of third plating includes the step of plating the nickel secondary layer to a thickness of from about 0.0001 to about 0.0002 inches.

12. The method of claim 1, wherein the step of fourth plating includes the step of electrolytically plating the gold layer from a potassium gold cyanide solution.

13. The method of claim 1, wherein the step of fourth plating includes the step of plating the gold layer to a thickness of from about 50 to about 100 microinches.

14. The method of claim 1, including an additional step, after the step of second plating and before the step of second activating, of sintering the substrate, the nickel strike layer, and the nickel primary layer.

15. The method of claim 1, including the additional steps, after the step of fourth plating, of providing a microelectronic device, and bonding the microelectronic device to the substrate overlying the gold layer.

16. A plated article prepared by the method of claim 1.

17. A method of preparing an article, comprising the steps of providing a substrate made of a copper-refractory metal material, wherein the refractory metal is selected from the group consisting of tungsten and molybdenum; thereafter first activating a surface of the substrate, the step of first activating including the steps of contacting the surface of the substrate with a concentrated alkaline solution at an alkaline activation temperature greater than room temperature, and thereafter contacting the surface of the substrate with a concentrated acidic solution; thereafter first plating the surface with a nickel strike layer; thereafter second plating the surface with a nickel primary layer overlying the nickel strike layer; thereafter sintering the substrate; thereafter second activating the surface of the nickel primary layer, the step of second activating including the step of contacting the surface of the nickel primary layer with a concentrated acidic solution; thereafter third plating the surface with a nickel secondary layer overlying the nickel primary layer; and thereafter fourth plating the surface with a gold layer overlying the nickel secondary layer.

18. The method of claim 17, including the additional steps, after the step of fourth plating, of providing a microelectronic device, and bonding the microelectronic device to the substrate overlying the gold layer.

19. A plated article prepared by the method of claim 17.

* * * * *